US005575200A

United States Patent [19]

Hartmann

[11] Patent Number: 5,575,200

[45] Date of Patent: Nov. 19, 1996

[54] METHOD FOR DETERMINING AND USING THE FILL AMOUNTS OF MATERIAL FOR PRESSING IN SOLID/LIQUID SEPARATION WITH A FILTER PRESS

[75] Inventor: Eduard Hartmann, Schneisingen, Switzerland

[73] Assignee: Bucher-Guyer AG, Niederweningen, Switzerland

[21] Appl. No.: 553,337

[22] PCT Filed: Mar. 21, 1995

[86] PCT No.: PCT/CH95/00062

§ 371 Date: Nov. 27, 1995

§ 102(e) Date: Nov. 27, 1995

[87] PCT Pub. No.: WO95/26874

PCT Pub. Date: Oct. 12, 1995

[30] Foreign Application Priority Data

Mar. 30, 1994 [CH] Switzerland ..... 946/94

[51] Int. Cl.[6] ..... B30B 9/02

[52] U.S. Cl. ..... 100/37; 100/45; 100/104; 426/231; 426/489

[58] Field of Search ..... 100/37, 43, 45, 100/104, 107, 99; 99/486, 495; 426/231, 478, 489

[56] References Cited

U.S. PATENT DOCUMENTS

| | | | |
|---|---|---|---|
| 4,467,715 | 8/1984 | Bunger | 100/45 |
| 4,568,549 | 2/1986 | Melandri | 426/489 |
| 5,207,154 | 5/1993 | Bonnet | 100/37 |
| 5,231,922 | 8/1993 | Hartmann | 100/37 |
| 5,275,740 | 1/1994 | Spyker et al. | 100/45 |

FOREIGN PATENT DOCUMENTS

| | | |
|---|---|---|
| 0485901 | 5/1992 | European Pat. Off. . |
| 2411699 | 7/1979 | France . |
| 2016258 | 9/1979 | United Kingdom . |
| 88/06518 | 9/1988 | WIPO . |

OTHER PUBLICATIONS

Database WPI, Week 7720, Derwent Publications Ltd., London, 77–E1485Y (SU A, 531,765) Food Ind Autom Res, 19 Nov. 1976.

Patent Abstracts of Japan, vol. 004, No. 128, JP A 55–86697, 30 Jun. 1980.

Patent Abstracts of Japan, vol. 004, No. 132, JP A 55–88999, 5 Jul. 1980.

Patent Abstracts of Japan, vol. 005, No. 072, JP A 56–23399, 5 Mar. 1981.

*Primary Examiner*—Stephen F. Gerrity

*Attorney, Agent, or Firm*—Burns, Doane, Swecker, & Mathis, LLP

[57] ABSTRACT

A determination of the amounts of fill of material (7) to be pressed in the solid-liquid separation by means of a filter piston press with a pressure element (6) for several successive pressing operations is made with the aid of a consideration in the yield/output diagram. Under a presupposition regarding the position of characteristic curves connecting various operating points in this diagram and by the interposition of an imaginary operating point it is possible to determine the changes in yield and output for each pressing operation and therefore the amounts of refill to be used in such a way that a maximal product of yield and output results for the solid-liquid separation operations when predetermining free process values. The method provides an automatic adaptation of the fill time to the compressibility of the materials. By means of this it is made possible to feed in material (7) of very different compressibility automatically and without having to predetermine reference values in such a way that an optimal behavior is achieved in respect to the yield and the juice extraction behavior of a filter press.

14 Claims, 6 Drawing Sheets

METHOD FOR DETERMINING AND USING THE FILL AMOUNTS OF MATERIAL FOR PRESSING IN SOLID/LIQUID SEPARATION WITH A FILTER PRESS

FIELD OF THE INVENTION

The invention relates to a method for the determination and use of the amounts of fill with material to be pressed in connection with the solid/liquid separation by means of a filter press, comprising a pressing chamber in which liquid is pressed out of the material to be filtered by the operation of a pressing element charged with a pressure force during several successive stroke actions, wherein a fill amount is placed into the pressing chamber during each stroke operation in the course of one filling phase of the separating process.

BACKGROUND OF THE INVENTION

In discontinuous filter presses of this type the liquid portion of the material to be pressed is let off to the outside via filters by means of the action of a compressing pressure. In the process the compressing pressure is applied directly to the material to be pressed via a rigid pressure plate or pneumatically or hydraulically via a flexible diaphragm. The question arises at the start of feeding-in the material to be pressed as to what amounts must be fed into the pressing chamber so that there is a press pad sufficient for a first pressing. It should be noted in this connection that in the extended position of the pressure plate or the diaphragm the ratio between the effective filter surface and the instantaneous pressing chamber volume is greater than with the pressing element retracted.

The question arises in connection with the subsequent further fill process as to what amounts should be refilled per stroke of the pressing element so that an advantageous juice extraction behavior is achieved. Different problems arise with organic and inorganic materials regarding the material to be pressed. In connection with organic materials it is typical that the processability in the press (compressibility) greatly changes from batch to batch. Accordingly, a known continuous adaptation of the process parameters by hand assumes great experience and continued monitoring of the press during the filling operation by the operators.

Known attempts to automate required adaptations of the process parameters have remained without results. A usable understanding of the processes during the pressing operation by means of a model has not been successful so far.

Filling of the presses in particular makes very high demands on the operator. For example, the following set points must be predetermined in connection with a horizontal filter press for fruit material:

Total amount of the fill. This is greatly dependent on the compressibility of the material to be pressed. Hard to compress materials permit only small amounts of fill, while easily compressible materials permit large amounts of fill.

Amount of pre-fill. The same requirements apply here as with the total amount of fill. Too small or to large amounts of pre-fill have a very negative effect on the yield/output behavior.

Amount of fill per piston stroke. Following the end of pre-filling, a defined amount of material to be pressed is added per piston stroke in known pressing operations. These batch-wise filling pulses take place until the predetermined total amount of fill has been achieved as the sum. The appropriate selection of this amount of fill as a process value also very heavily depends on the compressibility of the material.

The result as a whole is that the pressing results are very different, depending on the ability and experience of the operator since, because of the required guesses, manual predeterminations of the process parameters very seldom result in an optimal yield/output behavior of the pressing operations.

SUMMARY OF THE INVENTION

It is therefore the object of the invention to resolve the cited problems by means of an optimized method for determining and applying the fill amounts of material to be pressed in a filter press.

In accordance with the invention, this object is attained by means of the following steps: 1) a fill and pressing operation is performed while measuring the output and yield, which leads to a first operating point with known output and yield in the yield/output diagram; 2) in at least one subsequent second fill and pressing operation, which leads to a second operating point in the yield/output diagram, at least one process value is determined for the second operating point, and subsequently, by means of employing relationships regarding the changes in output and yield of the solid/liquid separation in the course of the fill and pressing operations by the interposition of an imaginary operating point, a fill amount is determined and used which is required so that a maximum product from yield and output results during the separating process, wherein the transition from the first operating point to the imaginary operating point takes place by means of a purely fill operation and the transition from the imaginary operating point to the second operating point takes place by means of a purely pressing operation and wherein it is presupposed that the straight-line connections of those operating points which differ by means of a purely pressing operation intersect in the yield/output diagram at a common operating point with maximum yield and vanishing output, or are parallel with each other.

Advantageous embodiments of the method ensue from the claims.

BRIEF DESCRIPTION OF THE DRAWINGS

Exemplary embodiments of the invention are described in detail in the following specification and in the drawing figures. Shown are in.

DESCRIPTION OF THE PREFERRED EMBODIMENTS

Figure 1:
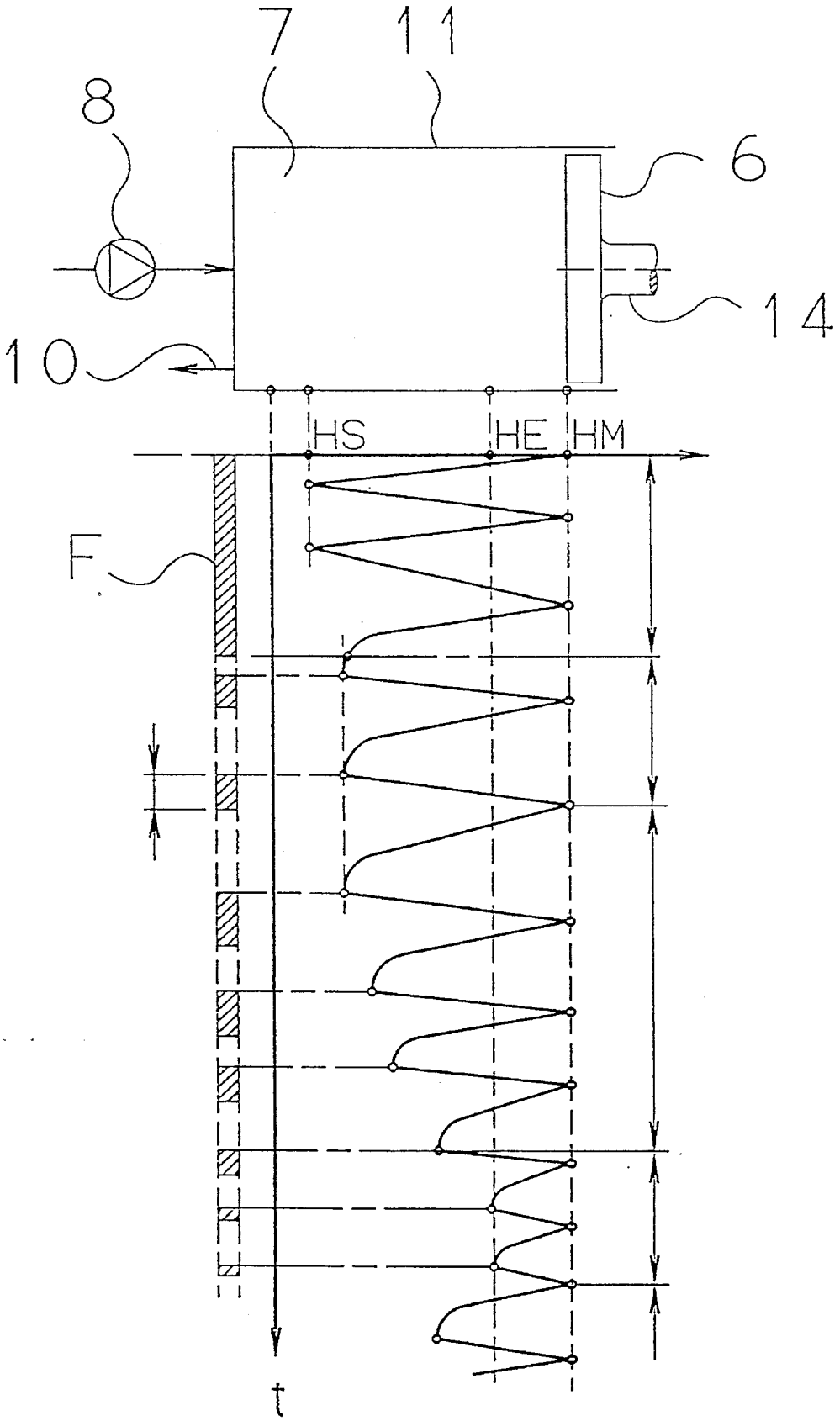
FIG. 1, a schematic section through a filter press with a pressure piston, along with a graphic representation of the course over time of piston strokes and feeding of the material to be pressed in the course of different control operations, FIG. 2, a schematic section through a filter press with a pressure piston, along with a graphic representation of the course over time of piston strokes and feeding of the material to be pressed in the course of further control operations, FIG. 3, various operational points resulting in a yield/output diagram in the course of feeding material to be pressed, FIG. 4, different pressing characteristics resulting in a yield/output diagram at different totally processed amounts of material to be pressed, FIG. 5, different control processes and their effect on the course of the press operations in a yield/output diagram, FIG. 6, a control process with even output as the predetermined process value in a yield/output diagram, FIG. 7, a control process with even yield as the predetermined process value in a yield/output diagram, FIG. 8, different operating points resulting in a yield/output diagram in the course of a fill operation without a simultaneous pressing effect by a pressure force at the pressure piston, and FIG. 9, different operating points resulting in a yield/output diagram in the course of fill and pressing operations in accordance with the invention in a filter piston press.

FIG. 1 schematically shows a horizontal filter piston press of a known type. It includes a press jacket 11. A pressure piston 6 fastened to a piston rod 14 is located inside the press jacket 11. The piston rod 14 is movably seated in a hydraulic cylinder and performs the pressing operations via the pressure piston 6. The material 7 to be pressed is fed by means of a pump 8 into the press jacket 11 through a closable feed opening and traverses a multitude of drain elements, not shown.

In the course of the pressing operation the drain elements conduct the liquid phase of the material 7 to be pressed through the action of the pressure piston 6 into a drain line 10 outward. The material to be pressed can be fruit and therefore the liquid phase fruit juice.

In the normal case the known course of the pressing operation is as follows:

Filling operation:

The pressure piston 6 is retracted and at the same time the material 7 to be pressed is fed in through the opening.

Pressing operation:

The entire press unit shown in FIG. 1 is rotated around the center axis,

The pressure piston 6 is advanced under pressure,

The juice is separated from the material to be pressed by pressure,

The compacting pressure is turned off.

Loosening operation:

The pressure piston 6 is retracted while the entire press unit shown in FIG. 1 is rotated, in the course of which the remaining material to be pressed is loosened and torn open.

Further pressing operation:

The process steps of pressing and loosening are repeated several times per batch of material to be pressed to constitute the pressing, until a desired final pressed-out state has been achieved.

Emptying operation:

The remainder of the pressing is emptied out by opening the press jacket 11.

The course of the process in connection with a filter piston press will be described in more detail, making reference to FIG. 1. Besides the already described plan of the filter piston press, associated graphic representations are shown there which show the piston strokes between the positions HM and HS and the fill function F over the time t. As represented by means of the time diagrams next to the press jacket 11, at the start the material 7 to be pressed is continuously fed by means of the pump 8 into the pressing chamber through an opening. In the course of this the pressure piston 6 is moved, starting at a position HM and, after reaching the position HS, is immediately retracted into its initial position HM. This process is repeated several times. A bar identified by F illustrates the continuous operation "pre- filling" taking place simultaneously.

The "pre-filling" operation is terminated as soon as the pressure piston 6 no longer reaches the position HS in the course of its advance. After that, in a following step, filling is performed only in discontinuous phases, which respectively start with the retraction of the pressure piston 6. In the course of this it is assured by means of a fill control that the pressure piston 6 always reaches the same end position, located in front of HS, during each piston operation.

In a further step, in the course of the advancing filling of the pressing chamber, the pressure piston 6 reaches positions which are continuously farther away from HS. In the process the fill control sees to it that the yield or the output of the pressing operation remains constant during each stroke and press operation. If, in the process, the pressure piston 6 reaches the position HE in its advance, it is then returned to the constant end position of the pressure piston 6 in the succeeding step, until the desired total amount of the material to be pressed has been fed in and further pressure strokes only take place without filling operations F.

Figure 2:
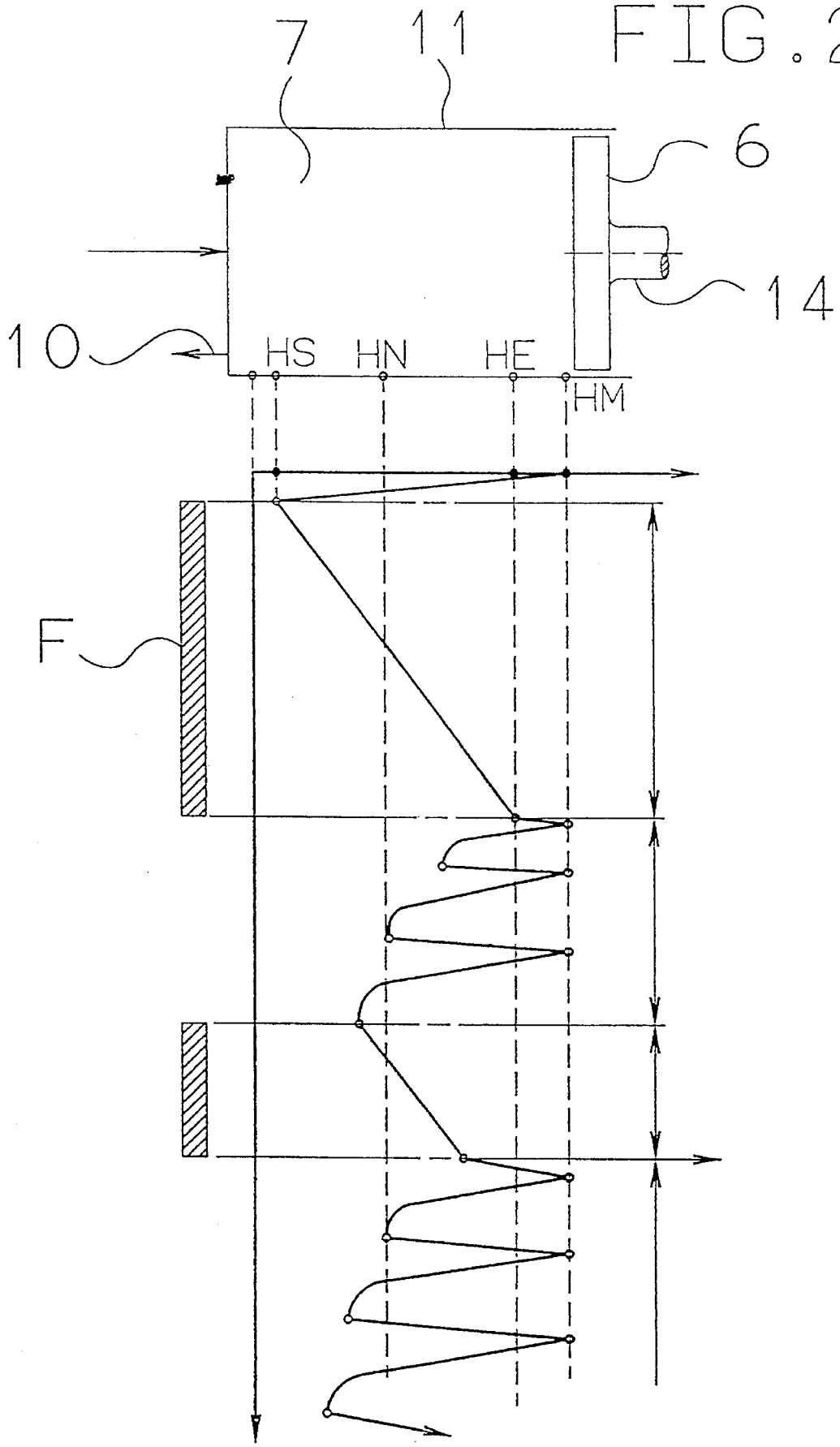

In a representation similar to that of FIG. 1, wherein the same reference symbols identify the same functions, FIG. 2 shows fill and pressing operations which are separated from each other. Prior to the start of "prefilling" which can be seen at the bar F, the pressure piston 6 advances to an end position HS. The pressure piston 6 is not locked during subsequent pre-filling, it is pushed back into a position HM by the pressure of the pumped-in material without performing pressure strokes. Following the termination of pre-filling, "pre-pressing" takes place by means of several strokes without filling operations, which is then again followed by further filling without pressure strokes as soon as the pressure piston 6 moves past a stroke position HN. Finally, the further pressure strokes only take place without any filling operations F.

Figure 3:
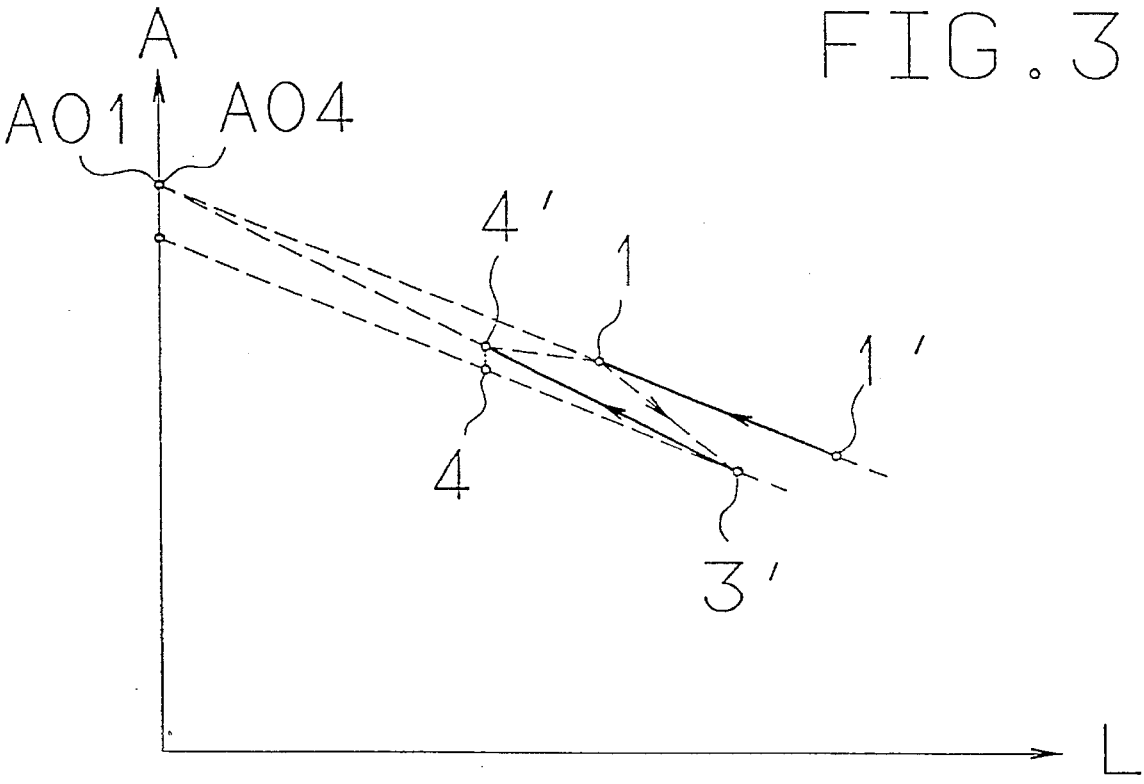

The differently controlled pressing operations described so far as examples can be represented in a yield/output diagram suitable for basic considerations, as shown in FIG. 3. In this case the following conventions apply Output L=(supplied amount of material to be pressed)/(work time used)

and

Yield A=(amount of juice generated)/(amount of material to be pressed used).

An operating point, identified by 1 in FIG. 3, corresponds to an instantaneous operational state of the press, such as occurs immediately following the end of a stroke operation within a series of individual pressings of the type described in connection with FIGS. 1 and 2. The pressure piston 6 is still in the pressing position at the operating point 1, but the working compression pressure has already been released. The previous stroke operation occurred at the operating point 1'. Thus, the operating points 1', 1 only differ by this one stroke movement. If at the operating point 1 a defined fill amount of material to be pressed is fed in, the operating point 1 changes to an operating point 3', wherein the output L is increased and the yield A is decreased. Thus, the operating points 1, 3' only differ by this fill operation.

Since stroke operations and fill operations take place combined in actual use, as described in connection with FIG. 1, the transitions 1', 1 and 1, 3', as well as the operating point 3', are imaginary Likewise, a stroke operation 3', 4' following 3', wherein the yield A is increased because of the amount of juice generated and the output L decreases because of the work time used. It is now assumed that the intersections A01 and A04 of the extended straight-line connections of the operating points 1', 1 and 3', 4' coincide with the A-axis, corresponding to an output zero. In accordance with the invention this makes it possible to predetermine a process value for the operating point 4' and to determine the amount of fill then required in such a way that the result is a maximum product of yield and output.

Although the fill amounts determined in this way lead to optimal results, in actual use the result is an operating point 4 of lesser yield, deviating from the operating point 4'. To determine the next following pressure stroke operation, the actually reached point 4 is combined with the previously determined imaginary point 3', corresponding to the pair 1, 1' of the previous stroke operation.

Figure 4:
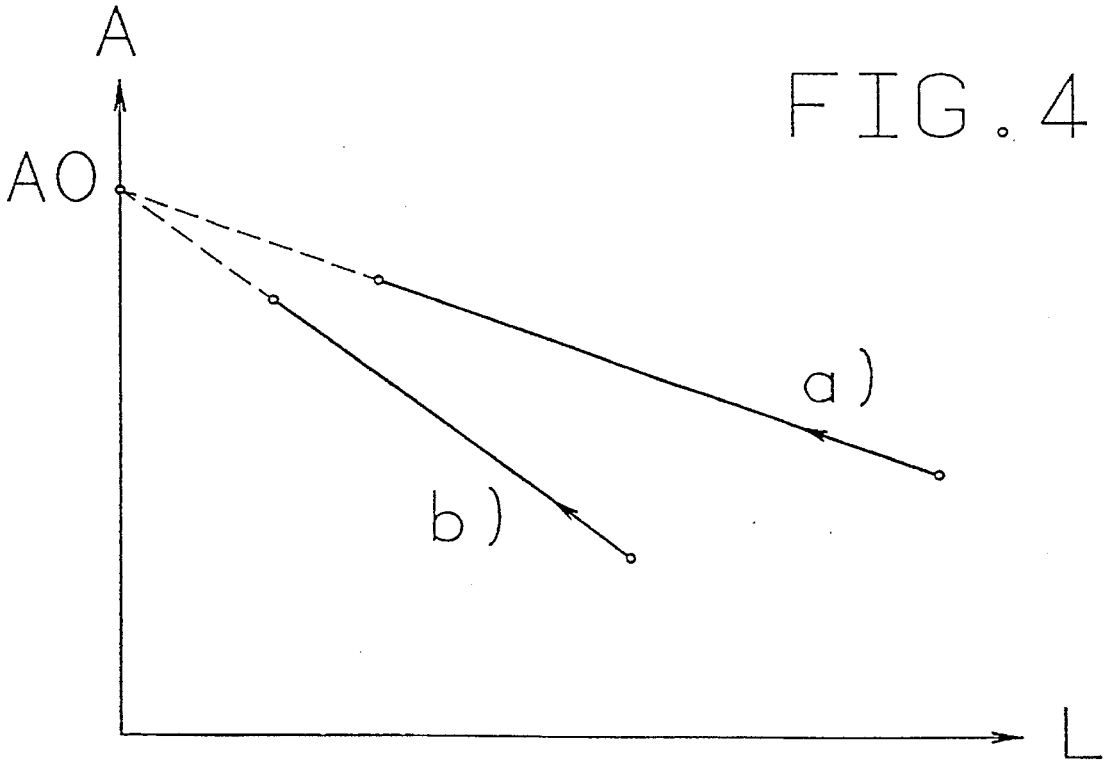

FIG. 4 shows, as a summarizing supplement to FIG. 3, a straight course of the press characteristic curve in the course of several purely pressing operations. Because of a lesser total amount of fill, the material to be pressed is in a state a) here. In comparison with this, another straight-line course applies to a state b) with a larger total amount of fill in the end state. Under idealized conditions, the extended courses a) and b) pass through a common intersection A0 with the yield axis, corresponding to an output value zero. In actual use this intersecting point A0 can change its position in the course of processing a batch of material to be pressed.

Figure 5:
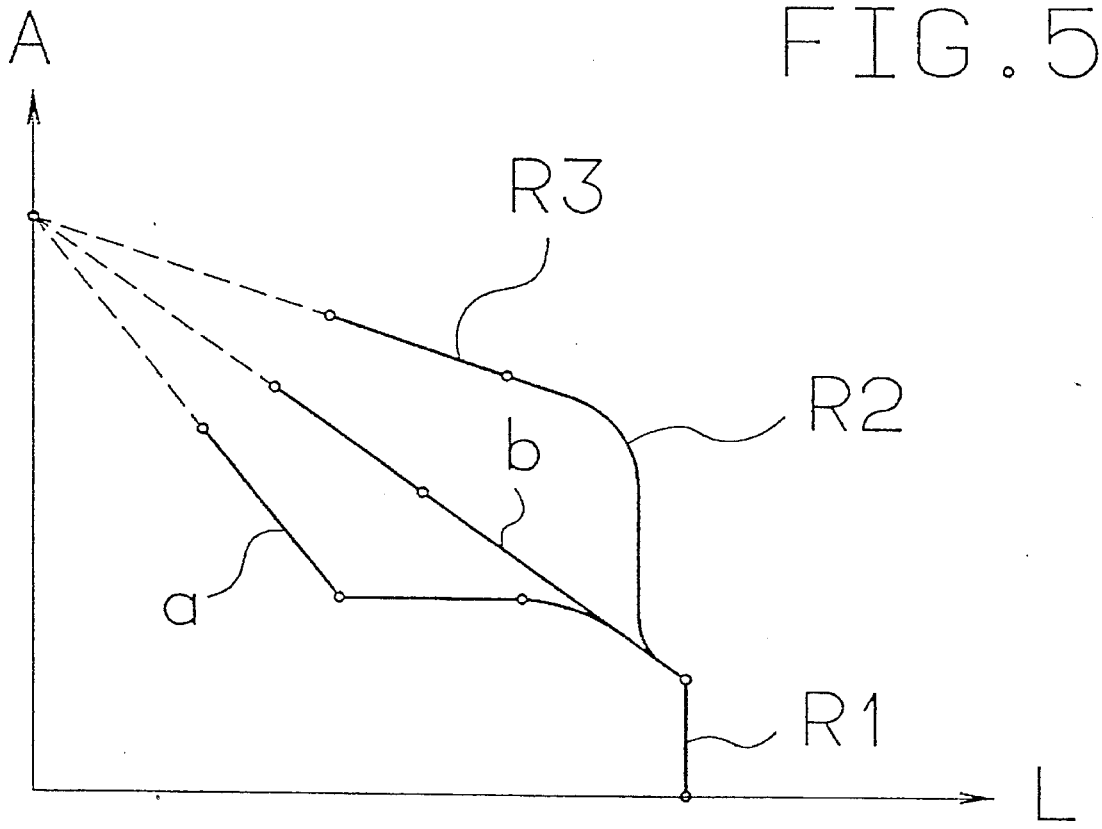

FIG. 5 in comparison shows the output-yield Combinations which can be achieved with various controls of the pressing operations. Starting with a pre-filling operation R1 and with constant output L and increasing yield A, the pressing operation R2 shows a control with the goal of constant output with an approximately sufficient refilling input. A pressing operation R3 without refill follows this. The course b represents a pressing operation with insufficient refilling. The course a finally shows three parts which result in sequence with a constant end position of the pressure element for each pressure stroke, with a constant yield and finally after termination of the filling.

Figure 6:
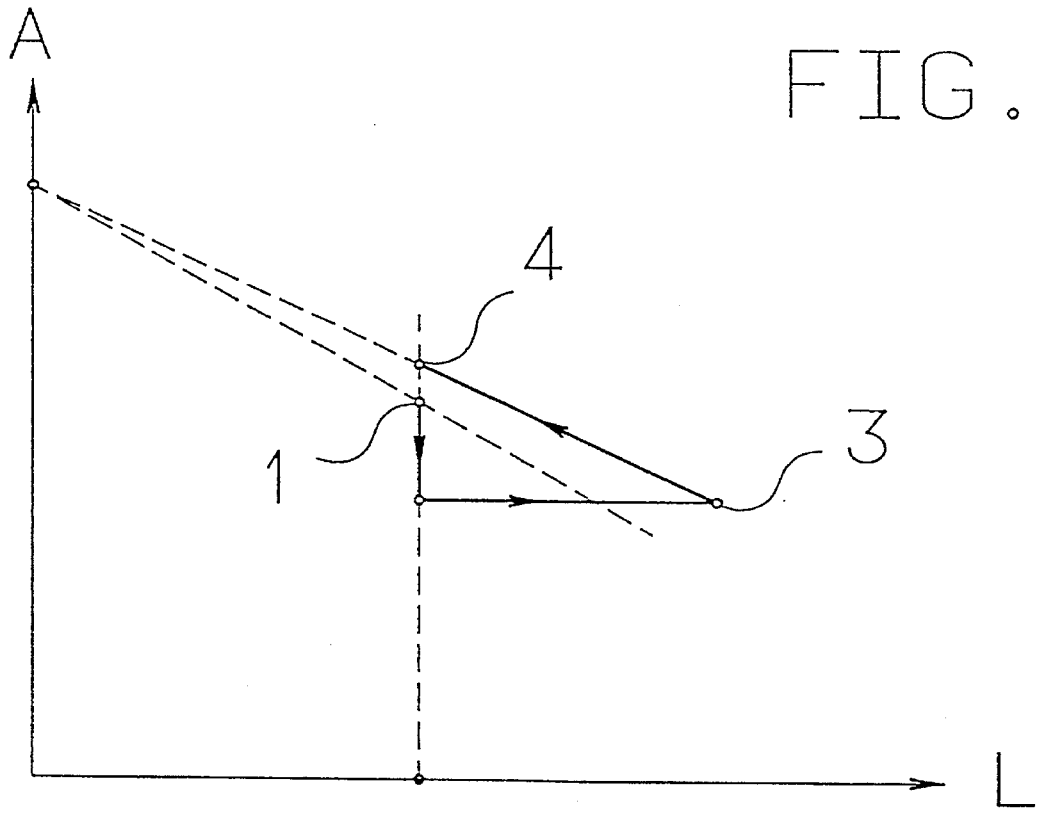

FIG. 6 shows the course of an individual pressing operation in the yield/output diagram, in which the output is kept constant between the operating points 1 at the beginning and 4 at the end. An improvement in the product of output and yield can be seen.

Figure 7:
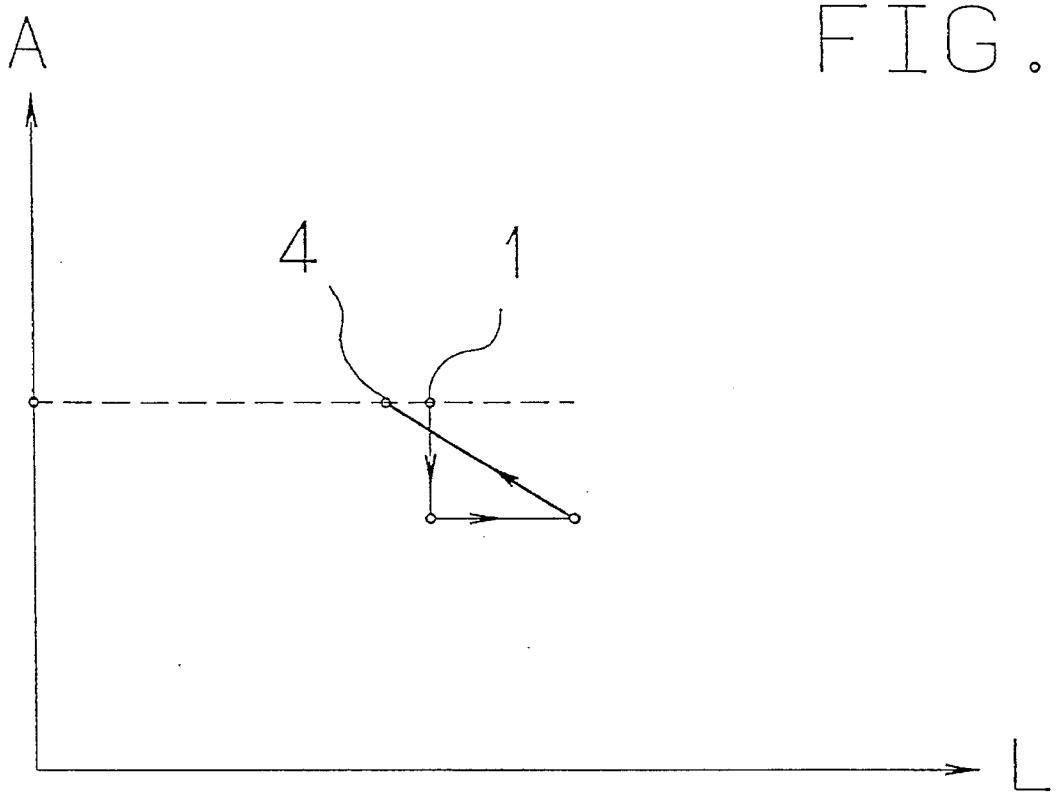

FIG. 7 shows the course of an individual pressing operation in the yield/output diagram, in which the amount of material to be pressed fed in between the operating points 1 at the beginning and 4 at the end is determined in such a way that the yield is kept constant. With a changed compressibility of the material it is also possible that a point 4 with increased output results to the right of point 1.

Figure 8:
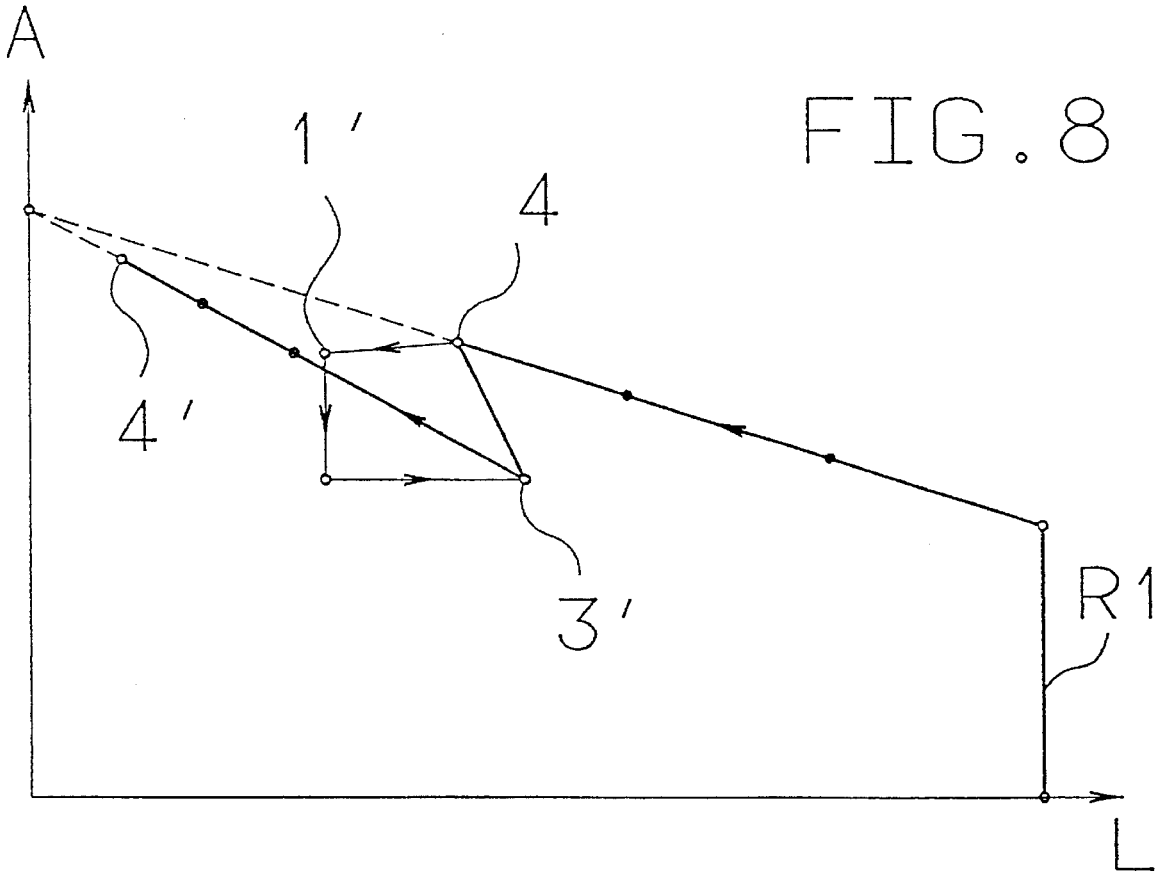

FIG. 8 shows the course of a pressing operation in the yield/output diagram, in which no refilling is performed during a pre-pressing operation following the pre-filling R1 and comprising several piston strokes. This operation was described in connection with FIG. 2. A pressure-free refill operation follows the pre-pressing, which leads from the point. 4 to the point 3'. Several pressing operations without refilling then again follow during the transition from point 3' to point 4'. The work time used for the pressure-free refilling operation is represented by a transition to a virtual operating point 1'.

Figure 9:
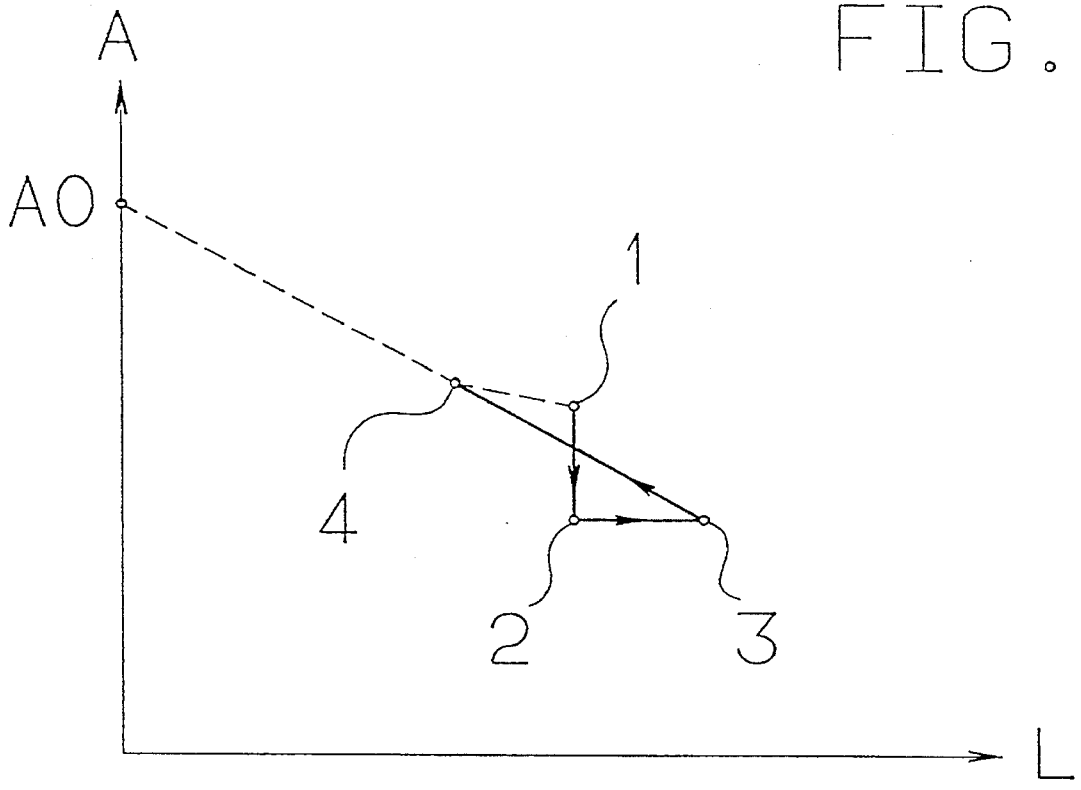

FIG. 9 shows how the effect of a supplied refill amount can be detected in the yield/output diagram by means of a theoretical consideration. Similarly as already described in connection with FIG. 3, the operating point 1 corresponds to the instantaneous operational state directly at the end of an individual previous pressure stroke. The pressure piston 6 (FIG. 1) is still in the pressing position HS, but the compression pressure has already been released. The pressing residue is thinned by the refill amount and the yield is reduced. At a point 2, reached virtually without using up any time by purely filling, the yield will be reduced while the output remains the same.

If G1 identifies the amount of material to be pressed fed in up to point 1, G2 is the amount fed in up to point 2, and A1 and A2 identify the yields at points 1 and 2, $$A2=A1\ (G1/G2) \tag{1}$$

At a virtually reached point 3 the output will rise, while the yield remains the same. If L1 and L2 identify the outputs at points 1 and 2, $$L3=L1\ (G2/G1) \tag{2}$$

Since the output is calculated from the amount of material to be pressed up to now and the time expired at this time, the output increases in the course of a feed of material to be pressed. Similarly to the way described in connection with FIG. 3, the virtually reached point 3 constitutes the starting point for the theoretical determination of the subsequent pressing step leading to point 4. The required consumption of work time Δt for this pressing step is predetermined by the pressing installation. Since it is furthermore presupposed by the invention that the straight-line extensions of the characteristic curves for the pressure stroke operations leading to point 1 and to point 4, for an output zero lead to the same point A0 on the yield axis, the process values L4 and A4 for the point 4 can be determined by connecting the points 3 and A0.

If G4=G3 again identifies the amounts supplied up to point 4 and Δt the press time leading to point 4, $$L4=L3\ (G3/(G3+L3*\Delta t)) \tag{3}$$

and $$A4=A0-((L4/L3)*(A0-A3)) \tag{4}$$

$$L4=L3\ ((A0-A4)/(A0-A3)) \tag{5}$$

From the presuppositions made and from the equations (1) to (5) it is therefore possible to determine in accordance with the invention the amounts of fill per stroke operation to be used as the differences ΔG of the amounts G4–G3 or G1, supplied up to the points 4 or 1 in accordance with $$\Delta G=G4-G1.$$

The following table shows the initial values A1, L1, the end values A4, L4, the refill amounts delta G determined in accordance with the invention and the actual strokes achieved for eight sequentially following fill—pressure stroke operations of a filter-piston press as a part of greater sequences of such operations for processing a total amount of materials to be pressed of 10,000 kg at a predetermined approximately constant pressure time of two minutes per pressure stroke operation and a path (stroke) of the pressure element constant for all pressure stroke operations of 500 mm as the predetermined process value:

TABLE

| n | A1 weight-% | L1 t/h | ΔG kg | Stroke mm | A4 weight-% | L4 t/h |
|---|---|---|---|---|---|---|
| 1 | 53.56 | 17.63 | 330 | 499.9 | 55.65 | 16.57 |
| 2 | 55.65 | 16.57 | 220 | 493.4 | 57.13 | 15.78 |
| 3 | 57.13 | 15.78 | 240 | 498.7 | 58.63 | 15.09 |
| 4 | 58.63 | 15.09 | 210 | 497.5 | 59.85 | 14.51 |
| 5 | 59.85 | 14.51 | 210 | 500.3 | 61.28 | 13.90 |
| 6 | 61.28 | 13.90 | 190 | 494.4 | 62.16 | 13.50 |
| 7 | 62.16 | 13.50 | 220 | 502.5 | 63.51 | 13.01 |
| 8 | 63.51 | 13.01 | 180 | 494.3 | 65.19 | 12.42 |

Figure 10:
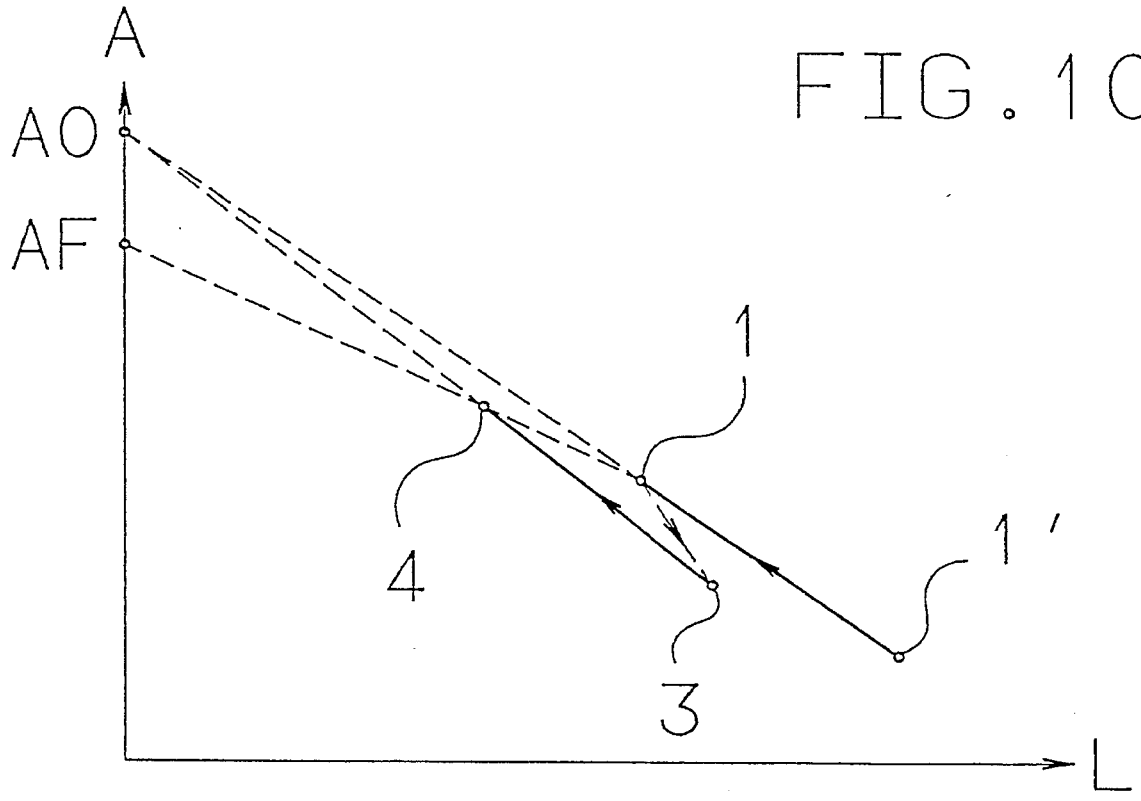
FIG. 10, different operating points resulting in a yield/output diagram in the course of fill and pressing operations in accordance with the invention in a filter piston press with a predetermined goal condition.

Similarly to FIGS. 3 and 9, FIG. 10 shows the operating points in a yield/output diagram which result if, for a second operating point 4, reached by means of a single fill and stroke operation from the operating point 1, the condition is predetermined, that the associated values of yield A4 and output L4 of this operating point 4 define a point 4 on the connecting straight line between the first operating point 1 and an operating point AF on the yield axis, which corresponds to a fixed, maximal theoretical yield value for the respective material to be pressed.

The determination of such a condition is practical particularly in the case where a material to be pressed, which has a mediocre compressibility, is to be processed. For a material of this kind a determination of a constant path (stroke) in the manner of the example shown in the above table would produce a lesser pressing result.

What is claimed is:

1. A method for the determination and use of the amounts of fill with material (7) to be pressed in connection with the solid/liquid separation by means of a filter press, comprising a pressing chamber (11) in which liquid is pressed out of the material (7) to be filtered by the action of a pressure element (6) charged with a pressure force during several successive stroke operations, wherein a fill amount is placed into the pressing chamber (11) during each stroke operation in the course of one filling phase of the separating process, characterized by the following steps: 1) a fill and pressing operation is performed while measuring the output (L) and yield (A), which leads to a first operating point (1) with known output (L1) and yield (A1) in the yield/output diagram; 2) in at least one subsequent second fill and pressing operation, which leads to a second operating point (4, 4') in the yield/output diagram, at least one process value is determined for the second operating point (4, 4'), and subsequently, by means of employing relationships regarding the changes in output (L) and yield (A) of the solid/liquid separation in the course of the fill and pressing operations by the interposition of an imaginary operating point (3, 3'), a fill amount (G4) is determined and used which is required so that a maximum product from yield (A4) and output (L4) results during the separating process, wherein the transition from the first operating point (1) to the imaginary operating point (3, 3') takes place by means of a purely fill operation and the transition from the imaginary operating point (3, 3') to the second operating point (4, 4') takes place by means of a purely pressing operation and wherein it is presupposed that the straight-line connections of those operating points (1', 1; 3' 4') which differ by means of a purely pressing operation intersect in the yield/output diagram at a common operating point (A0, A01, A04) with maximum yield (A) and vanishing output (L), or are parallel with each other.

2. A method in accordance with claim 1, characterized in that an end position of the pressure element (6) of the filter press is predetermined as the process value for the second operation point (4, 4').

3. A method in accordance with claim 2, characterized in that an output value of the solid-liquid separation is predetermined as the process value for the second operation point (4, 4') and in that the amounts of fill required for achieving the predetermined process values constant end position of the pressure element (6) and constant output of the solid-liquid separation with respect to the preceding fill and pressing operation are compared, and that the amount of fill necessary for achieving the predetermined constant output value is used for the fill and pressing operation leading from the first operating point to the second operating point if it is smaller than the fill amount necessary for achieving the predetermined end position.

4. A method in accordance with claim 3, characterized in that several fill and pressing operations are performed with the filter press which, in the yield/output diagram, result in several subsequent operating points, that for several of the subsequent operating points at least one process value to be achieved in accordance with claim 6 is predetermined and that for the fill and pressing operations for achieving the subsequent operating points the amounts of fill necessary for achieving the predetermined process values are determined from the equations for the changes of the output, yield and position of the pressure element (6) and are used for the fill and pressure operations leading to the respective operating points.

5. A method in accordance with claim 2, characterized in that a yield value of the solid-liquid separation is predetermined as the process value for the second operation point (4, 4') and in that at least two fill and pressing operations are performed with the filter press which, in the yield/output diagram, result in an operating point with a predetermined equal constant end position of the pressure element (6) of the filter press, and that for a subsequent operating point with the same constant end position of the pressure element (6) the yield of that fill and pressure operation is predetermined as the constant process value to be achieved, at which a maximal separated amount of liquid results.

6. A method in accordance with claim 5, characterized in that several fill and pressing operations are performed with the filter press which, in the yield/output diagram, result in several subsequent operating points, that for several of the subsequent operating points at least one process value to be achieved in accordance with claim 7 is predetermined and that for the fill and pressing operations for achieving the subsequent operating points the amounts of fill necessary for achieving the predetermined process values are determined from the equations for the changes of the output, yield and position of the pressure element (6) and are used for the fill and pressure operations leading to the respective operating points.

7. A method in accordance with claim 2, characterized in that several fill and pressing operations are performed with the filter press which, in the yield/output diagram, result in several subsequent operating points, that for several of the subsequent operating points at least one process value to be achieved in accordance with claim 2, is predetermined and that for the fill and pressing operations for achieving the subsequent operating points the amounts of fill necessary for achieving the predetermined process values are determined from the equations for the changes of the output, yield and position of the pressure element (6) and are used for the fill and pressure operations leading to the respective operating points.

8. A method in accordance with claim 1, characterized in that a yield value of the solid-liquid separation is predetermined as the process value for the second operation point (4, 4').

9. A method in accordance with claim 8, characterized in that several fill and pressing operations are performed with the filter press which, in the yield/output diagram, result in several subsequent operating points, that for several of the subsequent operating points at least one process value to be achieved in accordance with claim 3 is predetermined and that for the fill and pressing operations for achieving the subsequent operating points the amounts of fill necessary for achieving the predetermined process values are determined from the equations for the changes of the output, yield and position of the pressure element (6) and are used for the fill and pressure operations leading to the respective operating points.

10. A method in accordance with claim 1, characterized in that an output value of the solid-liquid separation is predetermined as the process value for the second operation point (4, 4').

11. A method in accordance with claim 10, characterized in that the yield value to be expected is determined for the predetermined output value for the second operating point (4, 4') and that no amount of fill is supplied if the yield value determined for the second operating point (4, 4') is less than the yield value known for the first operating point (1).

12. A method in accordance with claim 11, characterized in that several fill and pressing operations are performed with the filter press which, in the yield/output diagram, result in several subsequent operating points, that for several of the subsequent operating points at least one process value to be achieved in accordance with claim 5 is predetermined and that for the fill and pressing operations for achieving the subsequent operating points the amounts of fill necessary for achieving the predetermined process values are determined from the equations for the changes of the output, yield and position of the pressure element (6) and are used for the fill and pressure operations leading to the respective operating points.

13. A method in accordance with claim 10, characterized in that several fill and pressing operations are performed with the filter press which, in the yield/output diagram, result in several subsequent operating points, that for several of the subsequent operating points at least one process value to be achieved in accordance with claim 4 is predetermined and that for the fill and pressing operations for achieving the subsequent operating points the amounts of fill necessary for achieving the predetermined process values are determined from the equations for the changes of the output, yield and position of the pressure element (6) and are used for the fill and pressure operations leading to the respective operating points.

14. A method in accordance with claim 1, characterized in that for the second operating point (4, 4') the requirement is predetermined, that the associated values of yield (A4) and output (L4) result in an operating point in the yield/output diagram which is located on the connecting straight line between the first operating point (1) and an operating point (AF) on the yield axis which corresponds to a fixed maximal yield value for the respective material to be pressed.

* * * * *

UNITED STATES PATENT AND TRADEMARK OFFICE

CERTIFICATE OF CORRECTION

PATENT NO. : 5,575,200
DATED : November 19, 1996
INVENTOR(S) : Eduard HARTMANN

It is certified that error appears in the above-indentified patent and that said Letters Patent is hereby corrected as shown below:

At Column 8, line 18, in line 6 of claim 4, "6" is changed to --3--.

At Column 8, line 43, in line 6 of claim 6, "7" is changed to --5--.

At Column 9, line 6, in line 6 of claim 9, "3" is changed to --8--.

At Column 9, line 29, in line 6 of claim 12, "5" is changed to -11--.

At Column 10, line 12, in line 6 of claim 13, "4" is changed to --10-.

Signed and Sealed this

Thirteenth Day of October 1998

*Attest:*

Bruce Lehman

BRUCE LEHMAN

*Attesting Officer*

*Commissioner of Patents and Trademarks*